US006092041A

United States Patent [19]

Pan et al.

[11] Patent Number: 6,092,041

[45] **Date of Patent: *Jul. 18, 2000**

[54] SYSTEM AND METHOD OF ENCODING AND DECODING A LAYERED BITSTREAM BY RE-APPLYING PSYCHOACOUSTIC ANALYSIS IN THE DECODER

[75] Inventors: Davis Pan, Buffalo Grove; Otto Schnurr, Roselle, both of Ill.

[73] Assignee: Motorola, Inc., Schaumburg, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/701,293

[22] Filed: Aug. 22, 1996

[51] Int. Cl.[7] ..... G10L 7/02

[52] U.S. Cl. ..... 704/229; 704/230

[58] Field of Search ..... 704/229, 230, 704/206

[56] References Cited

U.S. PATENT DOCUMENTS

| | | | |
|---|---|---|---|
| 4,956,871 | 9/1990 | Swaminathan | 381/31 |
| 5,105,463 | 4/1992 | Veldhuis et al. | 395/2.38 |
| 5,151,941 | 9/1992 | Nishiguchi et al. | 381/46 |
| 5,227,788 | 7/1993 | Johnston et al. | 341/63 |
| 5,367,608 | 11/1994 | Veldhuis et al. | 395/2.38 |
| 5,621,660 | 4/1997 | Chaddha et al. | 364/514 |
| 5,692,102 | 11/1997 | Pan | 395/2.39 |

OTHER PUBLICATIONS

"Coding of Moving Pictures and Audio: MPEG–2 Audio NBC (13818–7) Committee Draft", M. Bosi, K. Brandenburg, S. M. Dietz, J.Johnston, J. Herre, H. Fuchs, Y. Oikawa, K. Akagiri, M. Coleman, M. Iwadare, C. Leuck ISO/IEC 13818–7:1996.

"Technical Description of the MPEG–4 Audio Coding Proposal from University of Hannover and Deutsche Bundespost Telekom",B. Edler (University of Hanover). ISO/IEC JTC1/SC29/WG11. MPEG95/0414, Oct. 1995.

MPEG4 Technical Description Cointribution of University of Erlangen/FhG–IIS, B. Grill, K–H.Brandenburg, ISO/IEC JTC1/SC29/WG11 MPEG95/0426, Oct. 26, 1995.

"Transform Coding of Audio Signals Using Perceptual Noise Criteria" James D. Johnston, IEEE Journal of Selected Areas in Communications, vol. 6, No. 2, Feb. 1988, pp 314–323.

"A Nonlinear Psychoacoustic Model Applied to the ISO MPEG Layer 3 Coder", F. Baumgarte, C. Frerekidis, and Hendrik Fuchs, AES 4087 (J–2).

Excerpts from ISP/IEC, Information Technology–Coding of Moving Pictures and Associated Audio for Digital Stoarge Media at up t Standard, 1993 "Psychoacoustic Models" pp D1–D–2, and pp 118–128.

(List continued on next page.)

*Primary Examiner*—Kevin J. Teska
*Assistant Examiner*—M. David Sofocleous
*Attorney, Agent, or Firm*—Darleen J. Stockley

[57] ABSTRACT

The invention provides a device, method (400,500,600), and system (100) to improve compression efficiency when coding audio for bitrate scalability. It includes at least one of an encoder and a decoder and is applicable when utilizing perceptual coding for an upper bitrate. The encoder includes a hybrid psychoacoustic modeling unit, coupled to receive lowband audio and diffband audio, for determining psychoacoustic data, and a quantizer control and zero-flagging unit, coupled to receive psychoacoustic data and diffband audio, for determining explicit quantizer stepsize parameters and at least one of: 1) implicit quantizer stepsize parameters and 2) implicit zero-flags. The decoder includes a lowband psychoacoustic model, coupled to receive lowband audio samples, for determining lowband psychoacoustic data, and a implicit quantizer stepsize and zero-flag computer, coupled to receive lowband psychoacoustic data for determining at least one of: 1) implicit quantizer stepsize parameters and 2) implicit zero-flags.

6 Claims, 6 Drawing Sheets

OTHER PUBLICATIONS

"Techniques for Improving the Performance of Celp Type Speech Coders", Ira A. Gerson and Mark A. Jasiuk, Corporate Systems Research Laboratories, Motoroal, Inc. pp 205–254.

"Predictive Coding of Speech Signals and Subjective Error Cirteria". Bishnu S. Atal, and Manfred R. Schroeder, IEEE Transactions on Acoustices, Speech, and Signal Processing, vol. ASSP–27, No. 3, Jun. 1979.

Grill et al. MPEG4 Technical Description, 1995.

Pan, Davis. A tutorial on MPEG/Audio compression. IEEE MultiMedia. vol. 2. Issue 2. 60–74, 1995.

100

300

400

500

600

SYSTEM AND METHOD OF ENCODING AND DECODING A LAYERED BITSTREAM BY RE-APPLYING PSYCHOACOUSTIC ANALYSIS IN THE DECODER

FIELD OF THE INVENTION

The present invention is related to digital audio compression coding and, more particularly, to scalable bitrate digital audio compression coding.

BACKGROUND OF THE INVENTION

Bitrate scalability is a useful feature for data compression coder and decoders. A scalable coder encodes a signal at a high bitrate so that subsets of this bitstream can be decoded at lower bitrates. One application of this feature is the remote browsing of data without the burden of downloading the full, high bitrate data file. Another application is for user-selectable audio quality for audio broadcasts. For the efficient use of code bits, the low bitrate streams should be used to help reconstruct the higher bitrate streams. One approach is to first encode data at a lowest supported bitrate, then encode an error between the original signal and a decoded lowest bitrate signal to form a second lowest bitrate bitstream and so on. For this scheme, difference coding, to work, the error signal must be easier to compress than the original. For this to be the case, the signal-to-noise ratio of the decoded lowest bitrate signal should be maximized.

In cases where there is a large difference between low and high bitrates in a scalable bitrate coder, more than one compression algorithm may be used to cover the different bitrates. A hybrid of compression algorithms is used to cover the full range of scalable bitrates. For the specific application of scalable bitrate audio compression, a coder optimized for low bitrate coding may be used to code the audio for the low bitrate while a high-quality, generic, audio compression algorithm is used to code the audio at the higher bitrates. Often the low bitrate coder is a speech coder. In this case, difference coding for scalable bitrates is difficult because low bitrate speech coders do not generally maximize the signal-to-noise ratio of the decoded output. Instead, many speech coders use spectral noise shaping to mask noise beneath the spectral peaks of the signal. This method is used because although the overall signal-to-noise ratio may be lower, the coding noise is less audible because of auditory masking.

Modern, high-quality, generic, audio compression algorithms take advantage of the noise masking characteristics of the human auditory system to compress audio data without causing perceptible distortions in the reconstructed audio signal. This form of compression is also known as perceptual coding. Most algorithms code a predetermined, fixed number of time-domain audio samples, a 'frame' of data, at a time. Since the noise masking properties depend on frequency, the first step of a perceptual coder is to map a frame of audio data to the frequency domain. The output of this time-to-frequency mapping process is a frequency domain signal where the signal components are grouped according to subbands of frequency. A psychoacoustic model analyzes the signal to determine both the signal-dependent and signal-independent noise masking characteristics as a function of frequency. These masking characteristics are expressed as signal-to-mask ratios for each subband of frequency. A quantizer control unit may then use these ratios to determine how to quantize the signal components within each subband such that the quantization noise will be inaudible. Quantizing the signal in this manner reduces the number of bits needed to represent the audio signal without necessarily degrading the perceived audio quality of the resulting signal. Representations of the quantizer output as well as quantizer stepsizes for each subband are coded into a compressed audio data stream.

There is a need for a coder, coding system and method that provide an efficient method of compressing audio signals when a hybrid arrangement of multiple audio coding algorithms is used to compress the audio data to achieve a scalable bitrate.

BRIEF DESCRIPTIONS OF THE DRAWINGS

DETAILED DESCRIPTION OF A PREFERRED EMBODIMENT

The present invention provides a novel system, coder and method for efficient scalable bitrate audio compression. The invention improves the efficiency of scalable bitrate audio compression by making greater use of information contained within a low bitrate audio bitstream when coding to a scalable higher bitrate audio bitstream with a perceptual coding algorithm. The invention is especially effective in improving coding efficiency when an independent coding algorithm, optimized for low bitrate coding, is used to code the low bitrate audio bitstream. In particular, the invention improves compression efficiency by decoding the low bitrate audio bitstream and using the decoded output to determine side information that otherwise has to be coded within the scalable higher bitrate audio bitstream. With the present invention, the side information that is deduced implicitly from the low bitrate audio bitstream consists of at least one of: 1) a group of quantizer stepsize parameters for subbands covered by the low bitrate coding algorithm; and 2) a group of zero-flags for frequency coefficients covered by the low bitrate coding algorithm. Thus, a maximal amount of information contained within a low bitrate code stream is exploited by a high bitrate coder in creating a high bitrate code stream.

A few definitions will help in describing the invention. Perceptual coders generally map a set of time domain audio samples into a set of frequency coefficients. Small groupings of adjacent frequency coefficients are called subbands. Subbands are mutually exclusive. Together the subbands cover all of the frequency coefficients and form a fullband. Subbands covered by the low bitrate coding algorithm are together called lowband. Lowband may also refer to time domain signals formed by transforming lowband frequency components to the time domain. Subbands outside of the lowband are called highband. Together, lowband and highband make up a fullband. When lowband coefficients are subtracted from fullband coefficients, the result is called diffband. Note fullband and diffband have the same number of frequency coefficients, but coefficient values in the lowband region are different. Side information for the diffband that may be deduced from the lowband is called implicit. All other side information is called explicit because the other information requires explicit representation in the bitstream. Psychoacoustic models used within the invention determine psychoacoustic data which is composed of at least one of: 1) diffband signal-to-mask ratios; and 2) lowband frequency coefficients and lowband masking thresholds. Lowband psychoacoustic data is composed of at least one of: 1) lowband signal-to-mask ratios; and 2) lowband frequency coefficients and lowband masking thresholds.

Figure 1:
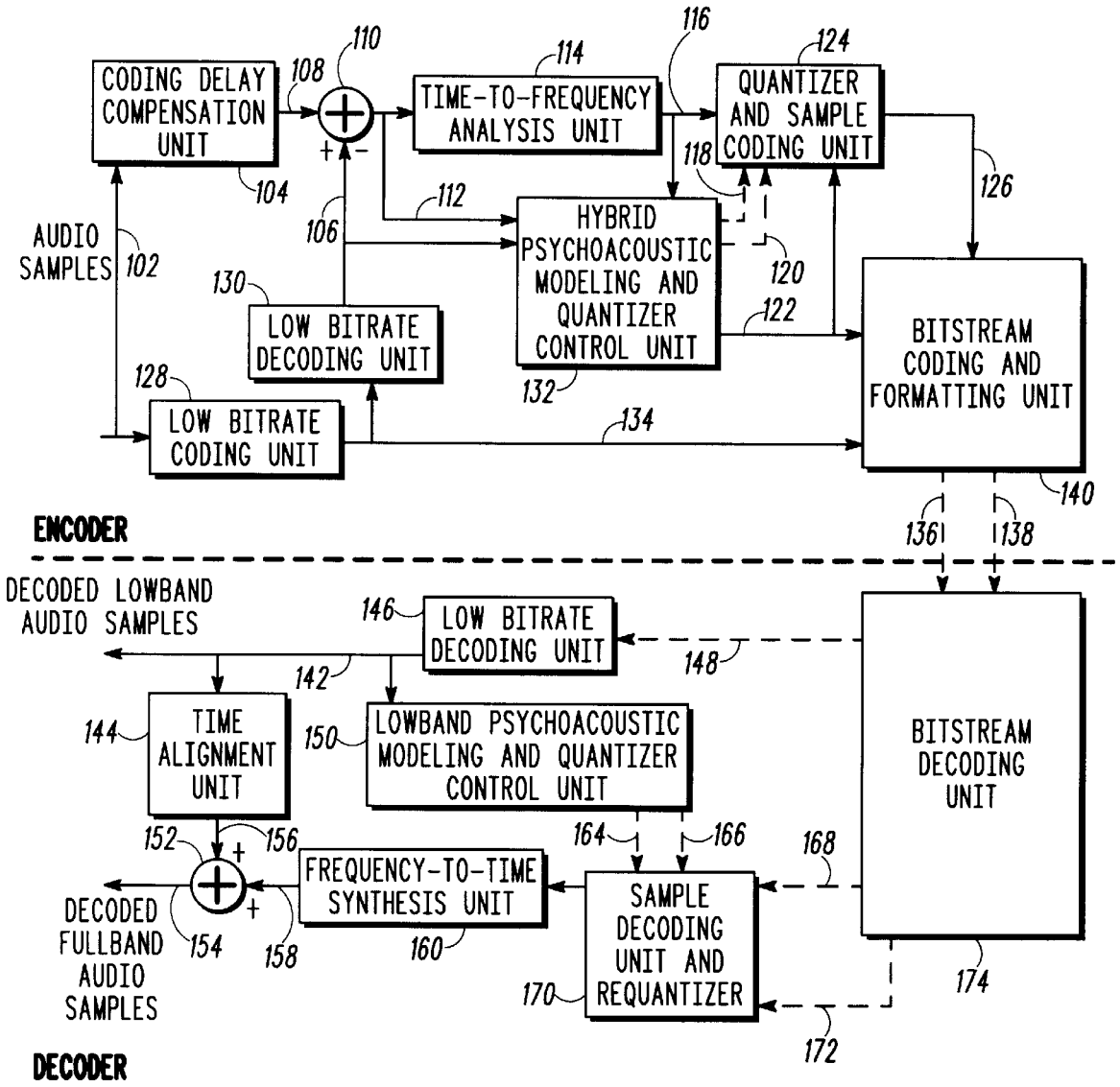
FIG. 1 is a block diagram of one embodiment of an audio compression system that utilizes an encoder and a decoder in accordance with the present invention.

FIG. 1, numeral 100, is a block diagram of one embodiment of an audio compression system that utilizes at least one of an encoder and a decoder in accordance with the present invention. The embodiment of FIG. 1 may be implemented with only two scalable bitrates, a low bitrate and a high bitrate, or alternatively, the low bitrate coding unit and the low bitrate decoding unit may provide additional scalable bitrates. A high bitrate bitstream is a combination of a low bitrate bitstream of coded lowband audio samples and a supplemental bitstream of coded diffband audio samples.

Figure 2:
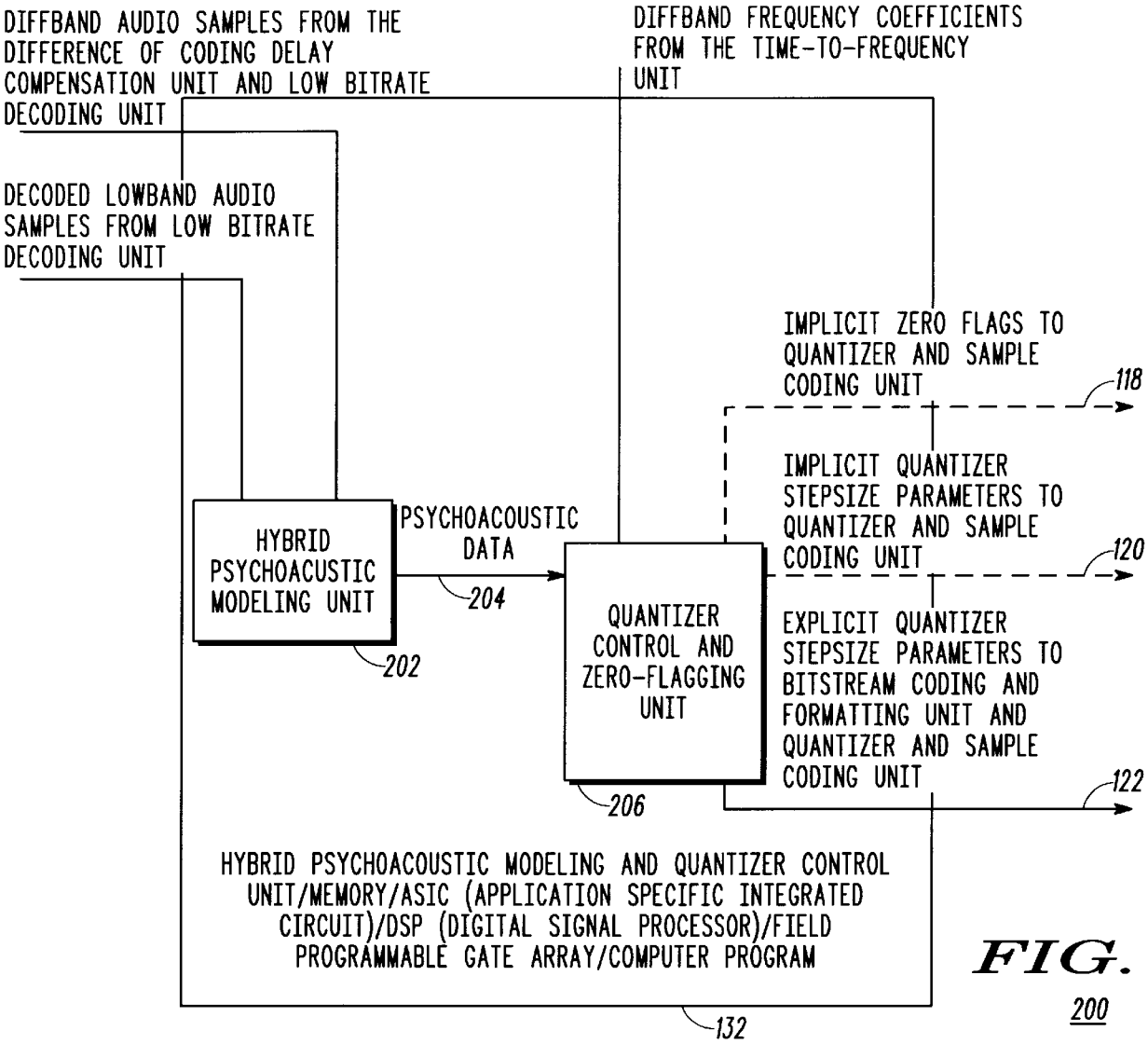
FIG. 2 is a block diagram of one embodiment of a hybrid psychoacoustic modeling and quantizer control unit/Memory/ASIC (application specific integrated circuit)/DSP (digital signal processor)/Field Programmable Gate Array/Computer Program of the encoder of FIG. 1 shown with greater particularity.

The encoder includes a hybrid psychoacoustic modeling and quantizer control unit/Memory/ASIC (application specific integrated circuit)/DSP (digital signal processor)/Field Programmable Gate Array/Computer Program (132). FIG. 2, numeral 200, is a block diagram of one embodiment of a hybrid psychoacoustic modeling and quantizer control unit shown with greater particularity. The hybrid psychoacoustic modeling and quantizer control unit consists of: A) a hybrid psychoacoustic modeling unit (202) that is coupled to receive decoded lowband audio samples (106) from a low bitrate decoding unit (130) and diffband audio samples (112) from a difference unit (110), and is used for determining psychoacoustic data (204) by means documented in published literature; B) a quantizer control and zero-flagging unit (206) that is coupled to receive at least one of: 1) psychoacoustic data (204) from the hybrid psychoacoustic modeling unit (202); and 2) diffband frequency coefficients (116) from the time-to-frequency analysis unit (114). The quantizer control and zero-flagging unit is used to determine explicit quantizer stepsize parameters (122) by means documented in published literature and at least one of: 1) implicit quantizer stepsize parameters (120) by means documented in published literature; and 2) implicit zero-flags (118).

During encoding, audio samples (102) are coded by a low bitrate coding unit (128) to produce a low bitrate bitstream (134). If the low bitrate coding unit (128) uses a low bitrate coding algorithm that operates at a different sampling rate than the input audio samples, the low bitrate coding unit (128) first converts the input sampling rate to the sampling rate required by the coding algorithm. The low bitrate bitstream (134) from the low bitrate coding unit (128) is decoded by a low bitrate decoding unit (130) to produce decoded lowband audio samples (106). When necessary, the low bitrate decoding unit sample rate converts decoded audio samples to lowband audio samples with a sampling rate that matches the input audio sampling rate. The audio samples (102) are also processed by a coding delay compensation unit (104) so that delayed audio samples (108) are time-synchronized with the decoded lowband audio samples (106) from the low bitrate decoding unit (130). A difference unit (110) subtracts values of the decoded lowband audio samples (106) from the delayed audio samples (108) to form diffband audio samples (112). A time-to-frequency analysis unit (114) maps diffband audio samples (112) from the difference unit (110) to diffband frequency coefficients (116). A hybrid psychoacoustic modeling and quantizer control unit (132) processes decoded lowband audio samples (106) from the low bitrate decoding unit (130), diffband audio samples (112) from the difference unit (110), and diffband frequency coefficients (116) from the time-to-frequency analysis unit (114) to produce explicit quantizer stepsize parameters (122) and at least one of: 1) implicit quantizer stepsize parameters (120); and 2) implicit zero-flags (118). The explicit quantizer stepsize parameters (122) need to be coded as side information in a supplemental bitstream (136). The implicit quantizer stepsize parameters (120) can be derived from the decoded lowband audio samples (106). In the absence of implicit quantizer stepsize parameters (120), all stepsize parameters are explicit and coded as side information. A quantizer and sample coding unit (124) quantizes and codes the diffband frequency coefficients (116) from the time-to-frequency analysis unit (114) into coded frequency coefficients (126) according to the implicit stepsize parameters (120), implicit zero-flags (118), and explicit quantizer stepsize parameters (122), all from the hybrid psychoacoustic modeling and quantizer control unit (132). A bitstream coding and formatting unit (140) codes and formats coded frequency coefficients (126) from the quantizer and sample coding unit (124), explicit quantizer stepsize parameters (122) from the hybrid psychoacoustic modeling and quantizer control unit (132), and the low bitrate bitstream (134) from the low bitrate coding unit (128) to form a scalable bitstream consisting of at least one of: 1) a low bitrate audio bitstream of coded lowband audio (138); and 2) a supplemental audio bitstream (136) of coded diffband audio. Both bitstreams together form a high bitrate bitstream.

To improve coding efficiency, an implicit zero-flagging mode may be used. Using the psychoacoustic data (204) from the hybrid psychoacoustic modeling unit (202), lowband frequency coefficients are compared against lowband masking thresholds.

Lowband frequency coefficients with values below the corresponding masking threshold are zero-flagged. Zero-flagged frequency coefficients can be replaced with zero without audible distortion. The Quantizer and Sample Coding Unit (124) omits coding of zero-flagged frequency coefficients when coding the diffband frequency coefficients (126).

Figure 3:
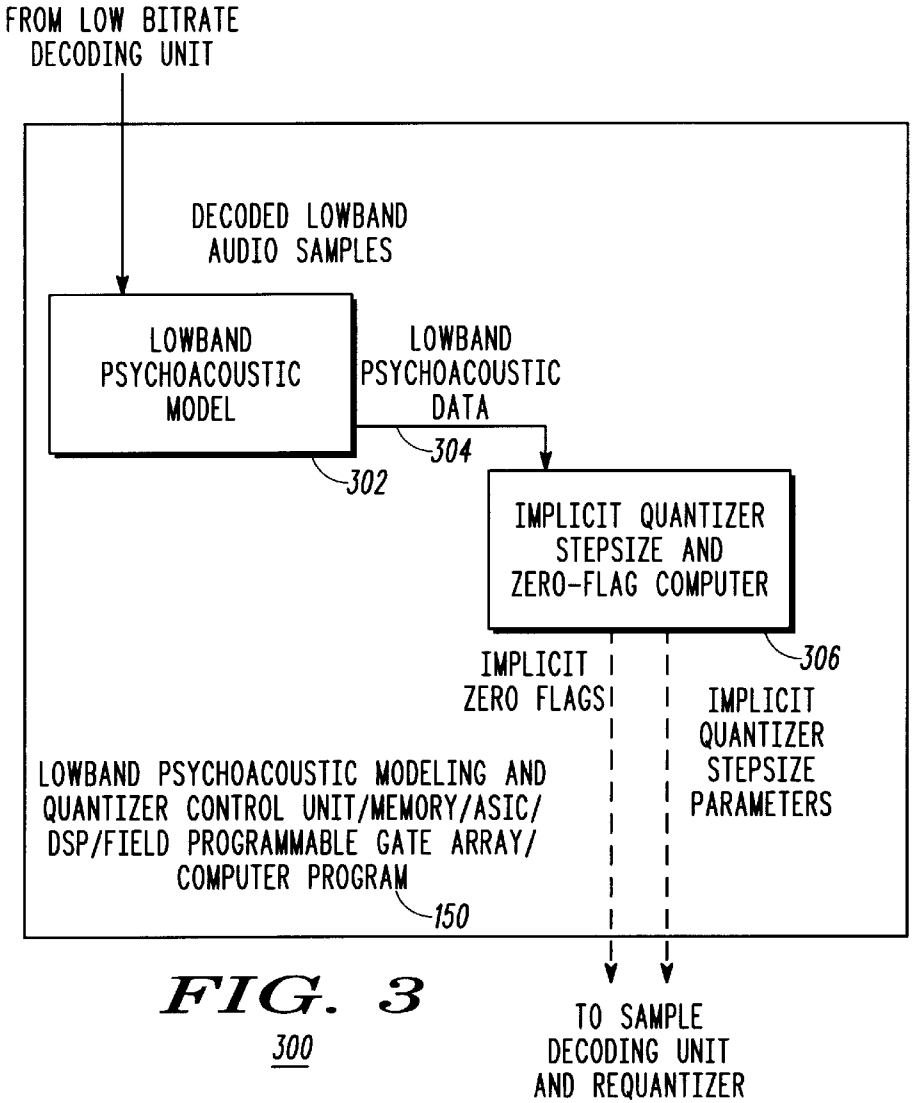
FIG. 3 is a block diagram of one embodiment of a lowband psychoacoustic modeling and quantizer control unit/Memory/ASIC/DSP/Field Programmable Gate Array/Computer Program of the decoder of FIG. 1 shown with greater particularity.

The decoder includes a lowband psychoacoustic modeling and quantizer control unit/Memory/ASIC (application specific integrated circuit)/DSP (digital signal processor)/Field Programmable Gate Array/Computer Program (150). FIG. 3, numeral 300, is a block diagram of one embodiment of a lowband psychoacoustic modeling and quantizer control unit shown with greater particularity. The lowband psychoacoustic modeling and quantizer control unit consists of: A) a lowband psychoacoustic model (302) that is coupled to receive decoded lowband audio samples (142) from a low bitrate decoding unit (146) and is used for determining lowband psychoacoustic data (304) by a means documented in published literature; B) an implicit quantizer stepsize and zero-flag computer (306) that is coupled to receive the lowband psychoacoustic data (304) from the lowband psychoacoustic modeling unit (302), and is used to determine at least one of: 1) implicit quantizer stepsize parameters (166) by means documented in published literature; and 2) implicit zero-flags (164).

During decoding, at least one of: 1) a low bitrate audio bitstream (138) of coded lowband audio; and 2) a supplemental audio bitstream (136) of coded diffband audio are processed by a bitstream decoding unit (174). If only the low bitrate audio bitstream (138) of coded lowband audio is available to the bitstream decoding unit (174) of the decoder, only decoded lowband audio samples (142) are output by the decoder. If both low bitrate audio bitstream (138) and supplemental audio bitstream (136) of coded diffband audio are sent to the decoder, lowband audio samples (142) and fullband audio samples (154) can be output by the decoder. The low bitrate audio bitstream (138) and the supplemental audio bitstream (136) do not have to be sent simultaneously to the decoder.

The bitstream decoding unit sends the low bitrate audio bitstream (138), if selected, to a low bitrate decoding unit (146) and decodes the supplemental audio bitstream (136), if selected, into coded diffband audio sample values (172) and explicit quantizer stepsize parameters (168). The low bitrate decoding unit (146) decodes the low bitrate audio bitstream (148) from the bitstream decoding unit (174) into decoded lowband audio samples (142). When necessary, the low bitrate decoding unit sample rate converts decoded audio samples to lowband audio samples with a sampling rate that matches the input audio sampling rate. A lowband psychoacoustic modeling and quantizer control unit (150) uses the decoded lowband audio samples (142) from the low bitrate decoding unit (146) to determine at least one of: 1) implicit quantizer stepsize parameters (166); and 2) implicit zero-flags (164). Using lowband psychoacoustic data (304), lowband frequency coefficients are compared against lowband masking thresholds. If zero-flagging mode is selected, lowband frequency coefficients with values below the corresponding masking threshold are zero-flagged. The sample decoding unit and requantizer (170) reconstructs requantized diffband frequency coefficients (162) from the coded diffband frequency coefficients (172) and the explicit quantizer stepsize parameters (168), both from the bitstream decoding unit (174), and at least one of: 1) implicit quantizer stepsize parameters (166); and 2) implicit zero-flags (164) provided by the lowband psychoacoustic modeling and quantizer control unit (150). The sample decoding unit and requantizer (170) reconstructs zero-flagged diffband frequency coefficients with zero values. A frequency-to-time synthesis unit (160) transforms the requantized diffband frequency coefficients (162) from the sample decoding unit and requantizer (170) into requantized diffband audio samples (158). A time alignment unit (144) synchronizes the decoded lowband audio samples (142) from the low bitrate decoding unit (146) with the requantized diffband audio samples (158) from the frequency-to-time synthesis unit (160). A summing unit (152) adds the time-aligned lowband audio samples (156) from the time alignment unit (144) to the requantized diffband audio samples (158) from the frequency-to-time synthesis unit (160) to form decoded fullband audio samples (154).

The above embodiment offers two possible scalable bitrates, a low bitrate and a high bitrate, or alternatively, may be generalized to more scalable bitrates by using low bitrate coding and decoding units (128, 130, 146) which further provide additional scalable bitrates.

Figure 4:
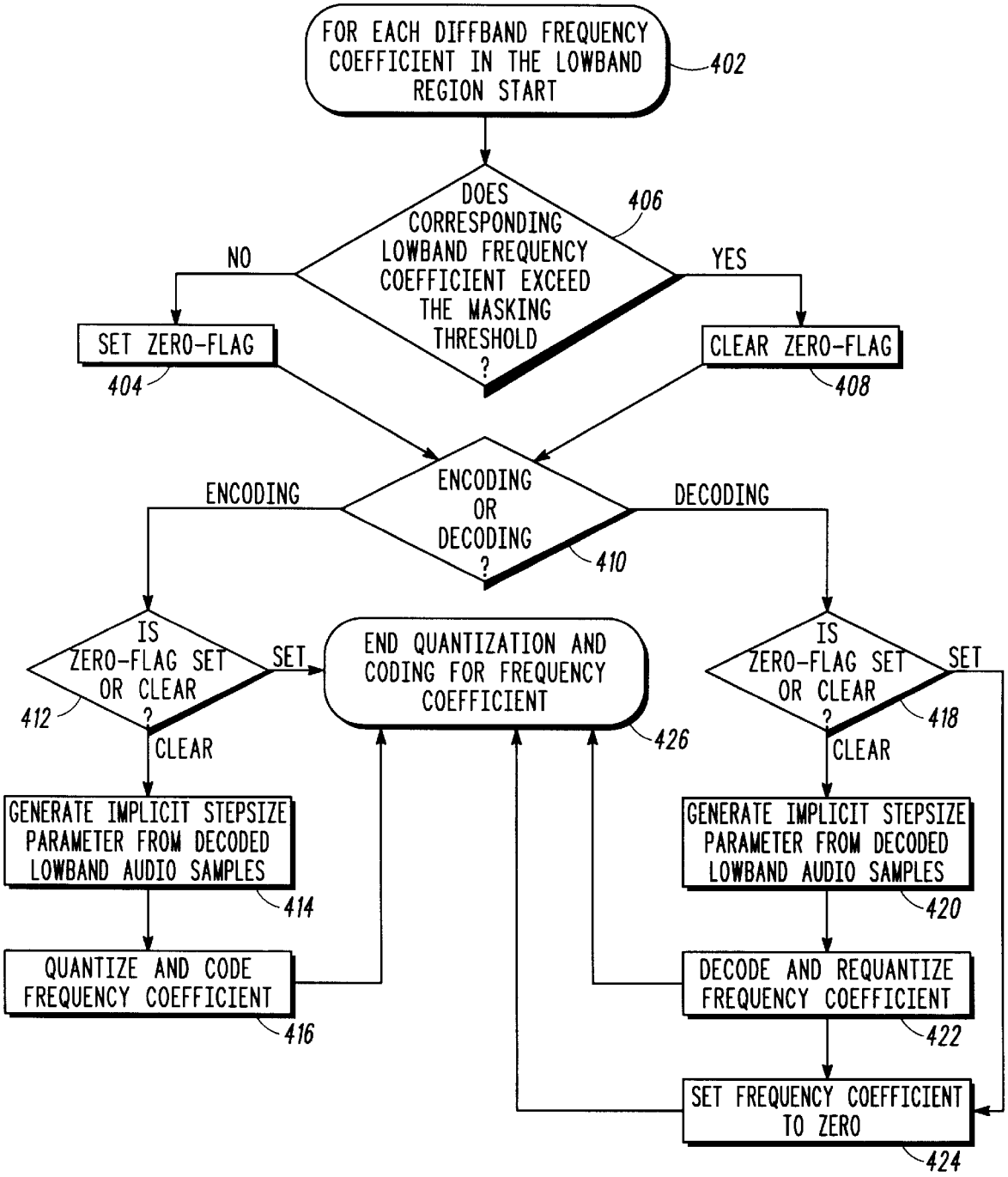
FIG. 4 is a flow chart showing steps for a preferred embodiment of a method in accordance with the present invention.

FIG. 4, numeral 400, is a flow chart showing steps for a preferred embodiment of a method in accordance with the present invention. The generation of implicit quantizer stepsize parameters and the generation and utilization of implicit zero-flags are shown in this embodiment. The embodiment may be used for each diffband frequency coefficient that has a lowband frequency coefficient of corresponding frequency (402). Lowband masking thresholds are used to identify and zero-flag corresponding diffband frequency coefficients (406, 404, 408). The remainder of the embodiment specifies separate steps for the encoder and decoder (410). In the encoder, zero-flagged diffband frequency coefficients may be omitted from coding (412, 426), and implicit quantizer stepsize parameters may be generated implicitly from the lowband frequency coefficients (414) to quantize and code the diffband frequency coefficients (416). In the decoder, zero-flagged diffband frequency coefficients may be replaced with zero without audible distortion (418,424), and implicit quantizer stepsize parameters may be generated implicitly from the lowband frequency coefficients (420) to decode and requantize the requantized diffband frequency coefficients (422).

Figure 5:
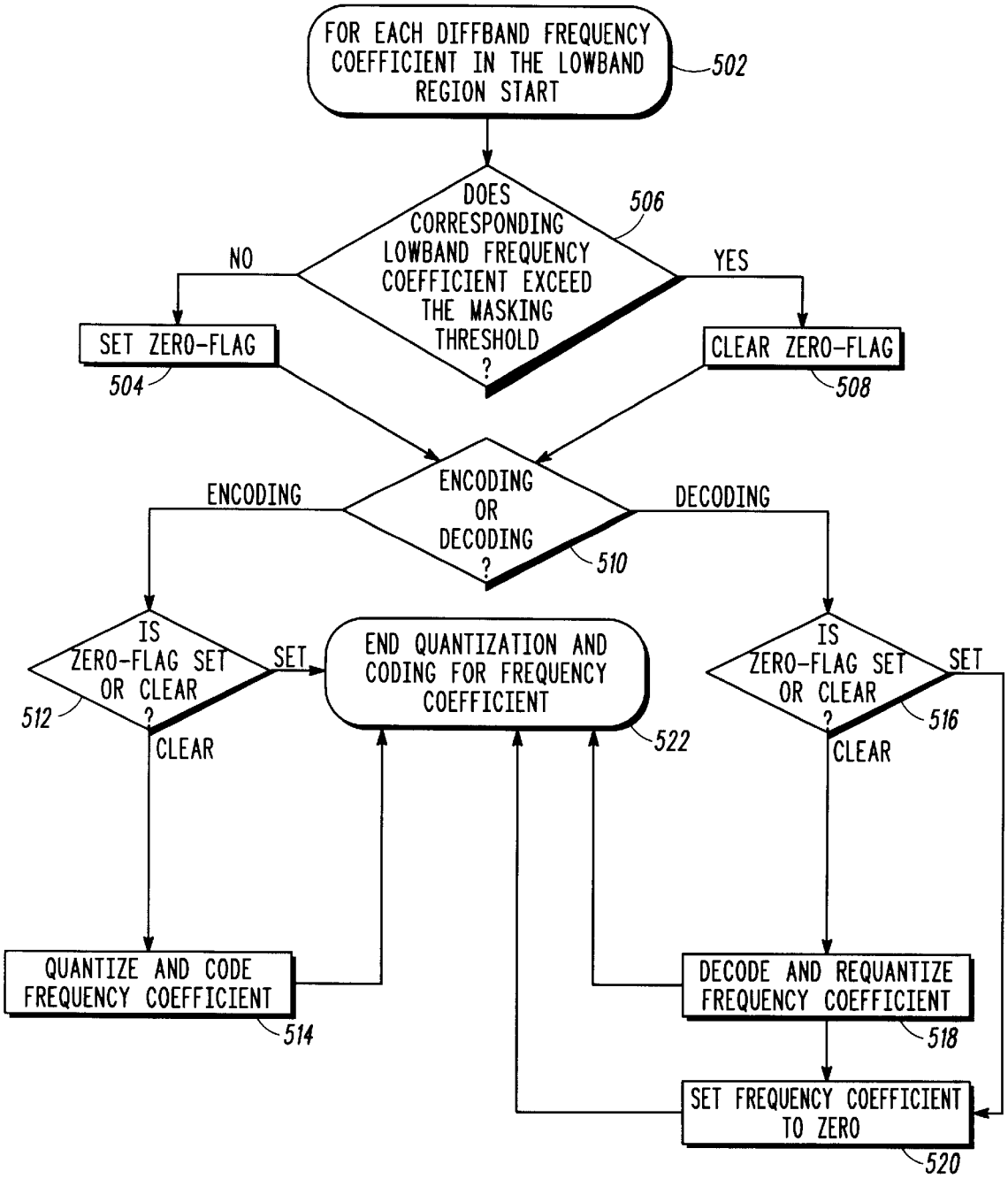
FIG. 5 is a flow chart showing steps for another preferred embodiment of a method in accordance with the present invention.

FIG. 5, numeral 500, is a flow chart showing steps for another preferred embodiment of a method in accordance with the present invention. The generation and utilization of implicit zero-flags are shown in this embodiment. The embodiment may be used for each diffband frequency coefficient that has a lowband frequency coefficient of corresponding frequency (502). Lowband masking thresholds are used to identify and zero-flag corresponding diffband frequency coefficients (506, 504, 508). The remainder of the embodiment specifies separate steps for the encoder and decoder (510). In the encoder, zero-flagged diffband frequency coefficients may be omitted (512, 522) instead of being quantized and coded (514). In the decoder, zero-flagged diffband frequency coefficients may be replaced with zero without audible distortion (516, 520) instead of being decoded and requantized (518).

Figure 6:
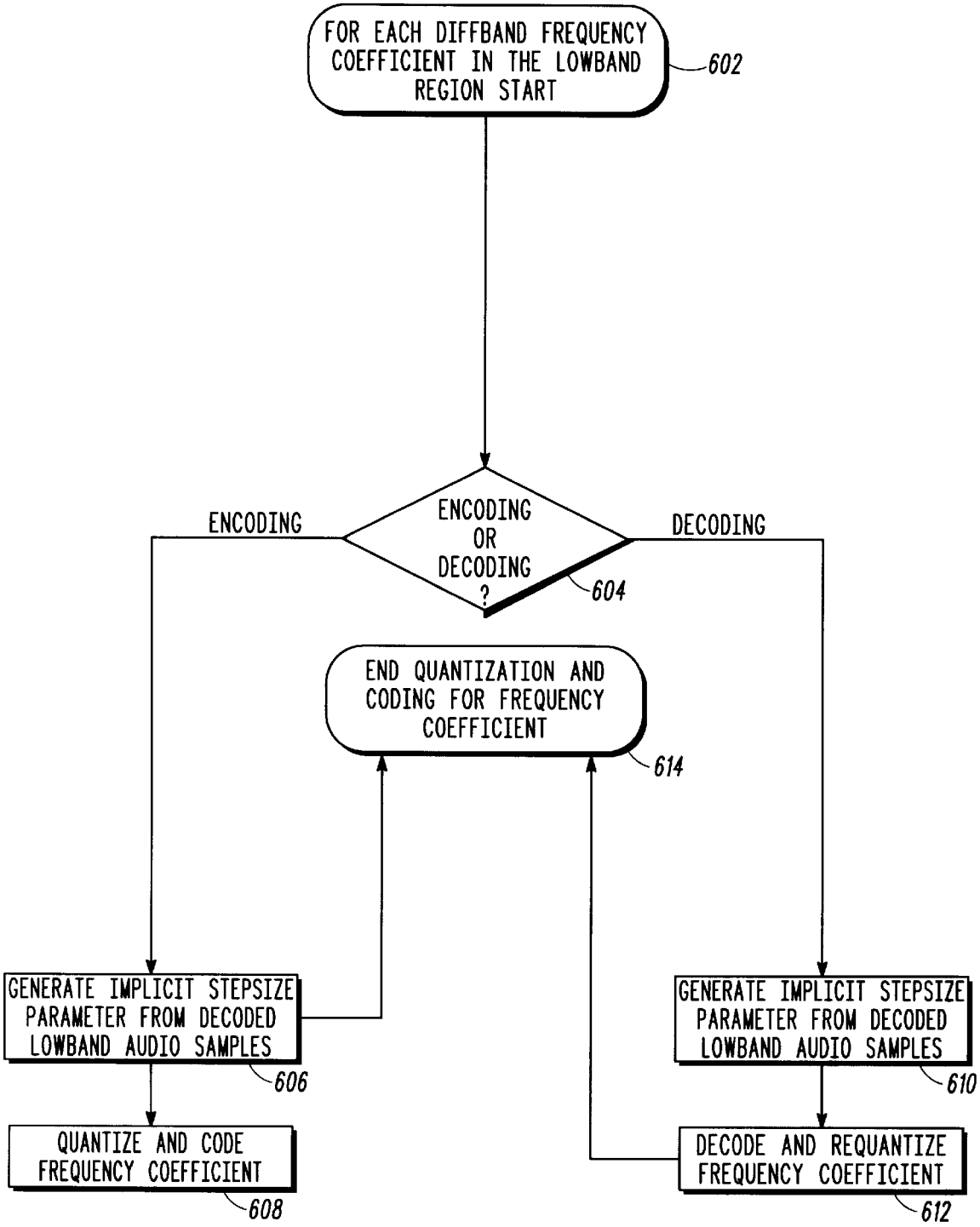
FIG. 6 is a flow chart showing steps for another preferred embodiment of a method in accordance with the present invention.

FIG. 6, numeral 600, is a flow chart showing steps for another preferred embodiment of a method in accordance with the present invention. The generation of implicit quantizer stepsize parameters is shown in this embodiment. The embodiment may be used for each diffband frequency coefficient that has a lowband frequency coefficient of corresponding frequency (602). The embodiment specifies separate steps for the encoder and decoder (604). In the encoder, implicit quantizer stepsize parameters may be generated implicitly from the lowband frequency coefficients (606) to quantize and code the diffband frequency coefficients (608). In the decoder, the implicit quantizer stepsize parameters may also be generated implicitly from the lowband frequency coefficients (610) to decode and requantize the requantized diffband frequency coefficients (612).

The method and device of the present invention may be selected to be implemented/embodied in at least one of: A) a computer-readable memory; B) an application specific integrated circuit; C) a digital signal processor; and D) a field programmable gate array; arranged and configured for providing hybrid scalable bitrate coding parameters in accordance with the scheme described in greater detail above.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

We claim:

1. A scalable bitrate audio compression system comprising at least one of A–B:

A) an encoder, comprising:

A1) a coding delay compensation unit, coupled to receive audio samples, for providing delayed audio samples for synchronizing the audio samples with an output of a low bitrate decoding unit;

A2) a low bitrate coding unit, coupled to receive the audio samples, for coding the audio samples to provide a low bitrate audio bitstream;

A3) the low bitrate decoding unit, coupled to the low bitrate coding unit, for generating decoded lowband audio samples;

A4) a difference unit, coupled to the coding delay compensation unit and the low bitrate decoding unit, for generating diffband audio samples by subtracting the decoded lowband audio from the delayed audio samples;

A5) a time-to-frequency analysis unit, coupled to the difference unit, for generating diffband frequency coefficients;

A6) a quantizer and sample coding unit, coupled to the time-to-frequency unit and a hybrid psychoacoustic modeling and quantizer control unit, for quantizing and coding the diffband frequency coefficients to provide coded diffband frequency coefficients wherein to improve coding efficiency, lowband frequency coefficients are compared against predetermined lowband masking thresholds, lowband frequency coefficients with values below a corresponding predetermined lowband masking threshold are zero-flagged, zero-flagged lowband frequency coefficients are replaced with zero, and the quantizer and sample coding unit omits coding of zero-flagged lowband frequency coefficients when coding the diffband frequency coefficients;

A7) the hybrid psychoacoustic modeling and quantizer control unit, coupled to the low bitrate decoding unit, the difference unit and the time-to-frequency analysis unit, for providing to the bitstream coding and formatting unit and to the quantizer and sample coding unit, explicit quantizer stepsize parameters and for providing to the quantizer and sample coding unit, A7a) implicit quantizer stepsize parameters; and A7b) implicit zero-flags;

A8) a bitstream and coding formatting unit, coupled to the quantizer and sample coding unit, the hybrid psychoacoustic modeling and quantizer control unit and the low bitrate coding unit, for generating at least one of:

A8a) a low bitrate audio bitstream of coded lowband audio from the low bitrate coding unit; and A8b) a supplemental audio bitstream for enhancing audio fidelity of the low bitrate audio bitstream, wherein the bitstream and coding formatting unit provides a hybrid bitstream comprising the low bitrate audio bitstream and the supplemental audio bitstream;

B) a decoder, comprising:

B1) a bitstream decoding unit, coupled to receive at least one of: the supplemental bitstream and the low bitrate audio bitstream, for redirecting the low bitrate audio bitstream to the low bitrate decoding unit and for separating the supplemental bitstream into explicit quantizer stepsize parameters and coded diffband frequency coefficients wherein the bitstream decoding unit separates the hybrid bitstream into explicit quantizer stepsize parameters, coded diffband frequency coefficients and the low bitrate audio bitstream;

B2) a low bitrate decoding unit, coupled to receive the low bitrate audio bitstream from the bitstream decoding unit, for generating decoded lowband audio samples wherein the low bitrate decoding unit further sample rate converts the decoded bitstream to match a sample rate of the audio samples;

B3) a lowband psychoacoustic modeling and quantizer control unit, coupled to the low bitrate decoding unit, for generating:

B3a) implicit quantizer stepsize parameters; and

B3b) implicit zero-flags;

B4) a sample decoding unit and requantizer, coupled to the bitstream decoding unit and the lowband psychoacoustic modeling and quantizer control unit, for decoding and requantizing requantized diffband frequency coefficients wherein, where zero-flagging mode is selected, the sample decoding unit and requantizer reconstructs requantized diffband frequency coefficients from coded diffband frequency coefficients and explicit quantizer stepsize parameters, both from the bitstream decoding unit, and at least one of: 1) implicit quantizer stepsize parameters; and 2) implicit zero-flags provided by the lowband psychoacoustic modeling and quantizer control unit and reconstructs zero-flagged diffband frequency coefficients with zero values:

B5) a frequency-to-time synthesis unit, coupled to the sample decoding unit and requantizer, for converting the requantized diffband frequency coefficients into requantized diffband audio samples;

B6) a time alignment unit, coupled to the low bitrate decoding unit, for synchronizing the output of the low bitrate decoding unit with the requantized diffband audio samples;

B7) a summer, coupled to the time-to-frequency synthesis unit and the time alignment unit, for summing the time-aligned, decoded, lowband audio samples with requantized diffband audio samples to provide fullband audio samples.

2. The scalable bitrate audio compression system of claim 1 wherein the low bitrate coding unit and the low bitrate decoding units further provide additional scalable bitrates.

3. A method for using a computer processor for providing scalable bitrate audio compression parameters, comprising:

A) generating, using a decoded lowband audio signal and a diffband audio signal, by a hybrid psychoacoustic modeling unit, psychoacoustic data that is composed of at least one of: signal-to-mask ratios, lowband frequency coefficients and lowband masking thresholds, wherein the hybrid psychoacoustic modeling unit performs scalable bitrate audio compression using the steps of at least one of A1–A2:

A1) in an encoder:

A1a) using a coding delay compensation unit for providing delayed audio samples for synchronizing the audio samples with an output of a low bitrate decoding unit;

A1b) using a low bitrate coding unit for coding the audio samples to provide a low bitrate audio bitstream:

A1c) using the low bitrate decoding unit for generating decoded lowband audio samples:

A1d) using a difference unit for generating diffband audio samples by subtracting the decoded lowband audio from the delayed audio samples:

A1e) using a time-to-frequency analysis unit for generating diffband frequency coefficients;

A1f) using a quantizer and sample coding unit for quantizing and coding the diffband frequency coefficients to provide coded diffband frequency coefficients wherein, where zero-flagging is implemented to improve coding efficiency, lowband frequency coefficients are compared against predetermined lowband masking thresholds, lowband frequency coefficients with values below a corresponding predetermined lowband masking threshold are zero-flagged, zero-flagged lowband frequency coefficients are replaced with zero, and the quantizer and sample coding unit omits coding of zero-flagged lowband frequency coefficients when coding the diffband frequency coefficients;

A1g) using a hybrid psychoacoustic modeling and quantizer control unit for providing to the bitstream coding and formatting unit and to the quantizer and sample coding unit, explicit quantizer stepsize parameters and for providing to the quantizer and sample coding unit, A1g1) implicit quantizer stepsize parameters; and A1g2) implicit zero-flags;

A1h) using a bitstream and coding formatting unit for generating at least one of:

A1h1) a low bitrate audio bitstream of coded lowband audio from the low bitrate coding unit; and A1h2) a supplemental audio bitstream for enhancing audio fidelity of the low bitrate audio bitstream, wherein the bitstream and coding formatting unit provides a hybrid bitstream comprising the low bitrate audio bitstream and the supplemental audio bitstream;

A2) in a decoder;

A2a) using a bitstream decoding unit for redirecting the low bitrate audio bitstream to the low bitrate decoding unit and for separating the supplemental bitstream into explicit quantizer stepsize parameters and coded diffband frequency coefficients wherein the bitstream decoding unit separates the hybrid bitstream into explicit quantizer stepsize parameters, coded diffband frequency coefficients and the low bitrate audio bitstream:

A2b) using a low bitrate decoding unit for generating decoded lowband audio samples wherein the low bitrate decoding unit further sample rate converts the decoded bitstream to match a sample rate of the audio samples;

A2c) using a lowband psychoacoustic modeling and quantizer control unit for generating at least one of:

A2c1) implicit quantizer stepsize parameters; and

A2c2) implicit zero-flags;

A2d) using a sample decoding unit and requantizer for decoding and requantizing requantized diffband frequency coefficients wherein, where zero-flagging mode is selected, the sample decoding unit and requantizer reconstructs requantized diffband frequency coefficients from coded diffband frequency coefficients and explicit quantizer stepsize parameters, both from the bitstream decoding unit, and 1) implicit quantizer stepsize parameters: and 2) implicit zero-flags provided by the lowband psychoacoustic modeling and quantizer control unit and reconstructs zero-flagged diffband frequency coefficients with zero values:

A2e) using a frequency-to-time synthesis unit for converting the requantized diffband frequency coefficients into requantized diffband audio samples:

A2f) using a time alignment unit for synchronizing the output of the low bitrate decoding unit with the requantized diffband audio samples:

A2g) using a summer for summing the time-aligned, decoded, lowband audio samples with requantized diffband audio samples to provide fullband audio samples; and B) generating, by a quantizer control unit and zero-flagging unit, explicit quantizer stepsize parameters and at least one of: implicit quantizer stepsize parameters and implicit zero-flags.

4. The method of claim 3 wherein the method is implemented by a computer program for providing scalable bitrate audio compression parameters, wherein the computer program is implemented/embodied in a tangible medium of at least one of:

A) a memory;

B) an application specific integrated circuit;

C) a digital signal processor; and

D) a field programmable gate array.

5. A hybrid psychoacoustic device for providing scalable bitrate audio compression parameters, wherein the hybrid psychoacoustic device includes a scalabitrate audio compression system comprising at least one of A–B:

A) an encoder, comprising:

A1) a coding delay compensation unit, coupled to receive audio samples, for providing delayed audio samples for synchronizing the audio samples with an output of a low bitrate decoding unit;

A2) a low bitrate coding unit, coupled to receive the audio samples, for coding the audio samples to provide a low bitrate audio bitstream;

A3) the low bitrate decoding unit, coupled to the low bitrate coding unit, for generating decoded lowband audio samples;

A4) a difference unit, coupled to the coding delay compensation unit and the low bitrate decoding unit, for generating diffband audio samples by subtracting the decoded lowband audio from the delayed audio samples;

A5) a time-to-frequency analysis unit, coupled to the difference unit, for generating diffband frequency coefficients;

A6) a quantizer and sample coding unit, coupled to the time-to-frequency unit and a hybrid psychoacoustic modeling and quantizer control unit, for quantizing and coding the diffband frequency coefficients to provide coded diffband frequency coefficients wherein, where zero-flagging is selected to improve coding efficiency, lowband frequency coefficients are compared against predetermined lowband masking thresholds, lowband frequency coefficients with values below a corresponding predetermined lowband masking threshold are zero-flagged, zero-flagged lowband frequency coefficients are replaced with zero, and the quantizer and sample coding unit omits coding of zero-flagged lowband frequency coefficients when coding the diffband frequency coefficients;

A7) the hybrid psychoacoustic modeling and quantizer control unit, coupled to the low bitrate decoding unit, the difference unit and the time-to-frequency analysis unit, for providing to the bitstream coding and formatting unit and to the quantizer and sample coding unit, explicit quantizer stepsize parameters and for providing to the quantizer and sample coding unit, A7a) implicit quantizer stepsize parameters; and A7b) implicit zero-flags;

A8) a bitstream and coding formatting unit, coupled to the quantizer and sample coding unit, the hybrid psychoacoustic modeling and quantizer control unit and the low bitrate coding unit, for generating at least one of:

A8a) a low bitrate audio bitstream of coded lowband audio from the low bitrate coding unit; and A8b) a supplemental audio bitstream for enhancing audio fidelity of the low bitrate audio bitstream, wherein the bitstream and coding formatting unit provides a hybrid bitstream comprising the low bitrate audio bitstream and the supplemental audio bitstream;

B) a decoder, comprising:

B1) a bitstream decoding unit, coupled to receive at least one of: the supplemental bitstream and the low bitrate audio bitstream, for redirecting the low bitrate audio bitstream to the low bitrate decoding unit and for separating the supplemental bitstream into explicit quantizer stepsize parameters and coded diffband frequency coefficients wherein the bitstream decoding unit separates the hybrid bitstream into explicit quantizer stepsize parameters, coded diffband frequency coefficients and the low bitrate audio bitstream;

B2) a low bitrate decoding unit, coupled to receive the low bitrate audio bitstream from the bitstream decoding unit; for generating decoded lowband audio samples wherein the low bitrate decoding unit further sample rate converts the decoded bitstream to match a sample rate of the audio samples:

B3) a lowband psychoacoustic modeling and quantizer control unit, coupled to the low bitrate decoding unit, for generating:

B3a) implicit quantizer stepsize parameters; and

B3b) implicit zero-flags;

B4) a sample decoding unit and requantizer, coupled to the bitstream decoding unit and the lowband psychoacoustic modeling and quantizer control unit, for decoding and requantizing requantized diffband frequency coefficients wherein, where zero-flagging mode is selected, the sample decoding unit and requantizer reconstructs requantized diffband frequency coefficients from coded diffband frequency coefficients and explicit quantizer stepsize parameters, both from the bitstream decoding unit, and at least one of: 1) implicit quantizer stepsize parameters; and 2) implicit zero-flags provided by the lowband psychoacoustic modeling and quantizer control unit and reconstructs zero-flagged diffband frequency coefficients with zero values;

B5) a frequency-to-time synthesis unit, coupled to the sample decoding unit and requantizer, for converting the requantized diffband frequency coefficients into requantized diffband audio samples;

B6) a time alignment unit, coupled to the low bitrate decoding unit, for synchronizing the output of the low bitrate decoding unit with the requantized diffband audio samples;

B7) a summer, coupled to the time-to-frequency synthesis unit and the time alignment unit, for summing the time-aligned, decoded, lowband audio samples with requantized diffband audio samples to provide fullband audio samples.

6. A computer having a hybrid psychoacoustic device for providing scalable bitrate audio compression parameters, wherein the hybrid psychoacoustic device includes a scalabitrate audio compression system comprising at least one of A–B:

A) an encoder, comprising:

A1) a coding delay compensation unit, coupled to receive audio samples, for providing delayed audio samples for synchronizing the audio samples with an output of a low bitrate decoding unit;

A2) a low bitrate coding unit, coupled to receive the audio samples, for coding the audio samples to provide a low bitrate audio bitstream;

A3) the low bitrate decoding unit, coupled to the low bitrate coding unit, for generating decoded lowband audio samples;

A4) a difference unit, coupled to the coding delay compensation unit and the low bitrate decoding unit, for generating diffband audio samples by subtracting the decoded lowband audio from the delayed audio samples;

A5) a time-to-frequency analysis unit, coupled to the difference unit, for generating diffband frequency coefficients;

A6) a quantizer and sample coding unit, coupled to the time-to-frequency unit and a hybrid psychoacoustic modeling and quantizer control unit, for quantizing and coding the diffband frequency coefficients to provide coded diffband frequency coefficients wherein to improve coding efficiency, lowband frequency coefficients are compared against predetermined lowband masking thresholds, lowband frequency coefficients with values below a corresponding predetermined lowband masking threshold are zero-flagged, zero-flagged lowband frequency coefficients are replaced with zero, and the quantizer and sample coding unit omits coding of zero-flagged lowband frequency coefficients when coding the diffband frequency coefficients;

A7) the hybrid psychoacoustic modeling and quantizer control unit, coupled to the low bitrate decoding unit, the difference unit and the time-to-frequency analysis unit, for providing to the bitstream coding and formatting unit and to the quantizer and sample coding unit, explicit quantizer stepsize parameters and for providing to the quantizer and sample coding unit, A7a) implicit quantizer stepsize parameters; and A7b) implicit zero-flags;

A8) a bitstream and coding formatting unit, coupled to the quantizer and sample coding unit, the hybrid psychoacoustic modeling and quantizer control unit and the low bitrate coding unit, for generating at least one of:

A8a) a low bitrate audio bitstream of coded lowband audio from the low bitrate coding unit; and A8b) a supplemental audio bitstream for enhancing audio fidelity of the low bitrate audio bitstream, wherein the bitstream and coding formatting unit provides a hybrid bitstream comprising the low bitrate audio bitstream and the supplemental audio bitstream:

B) a decoder, comprising:

B1) a bitstream decoding unit, coupled to receive at least one of: the supplemental bitstream and the low bitrate audio bitstream, for redirecting the low bitrate audio bitstream to the low bitrate decoding unit and for separating the supplemental bitstream into explicit quantizer stepsize parameters and coded diffband frequency coefficients wherein the bitstream decoding unit separates the hybrid bitstream into explicit quantizer stepsize parameters, coded diffband frequency coefficients and the low bitrate audio bitstream;

B2) a low bitrate decoding unit, coupled to receive the low bitrate audio bitstream from the bitstream decoding unit, for generating decoded lowband audio samples wherein the low bitrate decoding unit further sample rate converts the decoded bitstream to match a sample rate of the audio samples;

B3) a lowband psychoacoustic modeling and quantizer control unit, coupled to the low bitrate decoding unit, for generating:

B3a) implicit quantizer stepsize parameters; and

B3b) implicit zero-flags;

B4) a sample decoding unit and requantizer, coupled to the bitstream decoding unit and the lowband psychoacoustic modeling and quantizer control unit, for decoding and requantizing requantized diffband frequency coefficients wherein, where zero-flagging mode is selected, the sample decoding unit and requantizer reconstructs requantized diffband frequency coefficients from coded diffband frequency coefficients and explicit quantizer stepsize parameters, both from the bitstream decoding unit, and at least one of: 1) implicit quantizer stepsize parameters: and 2) implicit zero-flags provided by the lowband psychoacoustic modeling and quantizer control unit and reconstructs zero-flagged diffband frequency coefficients with zero values;

B5) a frequency-to-time synthesis unit, coupled to the sample decoding unit and requantizer, for converting the requantized diffband frequency coefficients into requantized diffband audio samples;

B6) a time alignment unit, coupled to the low bitrate decoding unit, for synchronizing the output of the low bitrate decoding unit with the requantized diffband audio samples;

B7) a summer, coupled to the time-to-frequency synthesis unit and the time alignment unit, for summing the time-aligned, decoded, lowband audio samples with requantized diffband audio samples to provide fullband audio samples.

* * * * *